US006087786A

United States Patent [19]

Allen et al.

[11] Patent Number: 6,087,786

[45] Date of Patent: Jul. 11, 2000

[54] METHODS OF CONTROLLING THE BRIGHTNESS OF A GLOW DISCHARGE

[75] Inventors: Philip Charles Allen, Middlesex; Andrew David Barnes, Warrington; Ian Gordon Gibb, Middlesex; Alan Cooper Sharp, Hertfordshire; Steven Edward Coe; Gregory Colin Truman, both of Surrey, all of United Kingdom

[73] Assignee: Central Research Laboratories Limited, Middlesex, United Kingdom

[21] Appl. No.: 09/051,747

[22] PCT Filed: Oct. 14, 1996

[86] PCT No.: PCT/GB96/02499

§ 371 Date: Dec. 24, 1998

§ 102(e) Date: Dec. 24, 1998

[87] PCT Pub. No.: WO97/15172

PCT Pub. Date: Apr. 24, 1997

[30] Foreign Application Priority Data

Oct. 20, 1995 [GB] United Kingdom ..... 9521573

[51] Int. Cl.[7] ..... G05F 1/00

[52] U.S. Cl. ..... 315/291; 315/246; 315/307; 315/DIG. 4; 345/102

[58] Field of Search ..... 315/246, 291, 315/150, 63, DIG. 2, DIG. 4, 307; 345/102, 213, 87

[56] References Cited

U.S. PATENT DOCUMENTS

| | | | |
|---|---|---|---|
| 4,219,760 | 8/1980 | Ferro | 315/248 |
| 4,358,716 | 11/1982 | Cordes et al. | 315/306 |
| 4,402,598 | 9/1983 | Tomosada et al. | 355/69 |
| 4,484,107 | 11/1984 | Kaneda | 315/176 |
| 4,920,302 | 4/1990 | Konopka | 315/307 |
| 4,996,606 | 2/1991 | Kawai et al. | 358/475 |
| 4,998,046 | 3/1991 | Lester | 315/209 R |
| 5,072,155 | 12/1991 | Sakurai et al. | 315/219 |
| 5,111,115 | 5/1992 | Ball et al. | 315/239 |
| 5,349,273 | 9/1994 | Pacholok | 315/307 |

OTHER PUBLICATIONS

Japanese Abstract No. 06–283293, Oct. 7, 1994.
Japanese Abstract No. 08–069886, Mar. 12, 1996.
Japanese Abstract No. 08–190899, Jul. 23, 1996.

*Primary Examiner*—Haissa Philogene
*Attorney, Agent, or Firm*—Evenson, McKeown, Edwards & Lenahan, PLLC

[57] ABSTRACT

Methods of controlling the brightness of a glow discharge which switches from a low brightness state to a high brightness state a given time after the start of an excitation pulse are described. In the first method, conventional pulse duration modulation produces a dimming ratio much greater than the ratio of duty factor variation. In the second method, a plurality of sets of pulses having different fixed durations but variable repetition rates are employed. In the third method, a plurality of sets of pulses having different relative durations have their pulse durations modulated in synchrony.

22 Claims, 5 Drawing Sheets

METHODS OF CONTROLLING THE BRIGHTNESS OF A GLOW DISCHARGE

BACKGROUND AND SUMMARY OF THE INVENTION

This invention relates to methods of controlling the brightness of a glow discharge. The methods relate particularly, though not exclusively, to light sources for backlighting liquid crystal displays.

Glow discharge light sources are increasingly being used as backlights for liquid crystal displays. Such backlights must be capable of high brightness for use in direct sunlight, and have applications in vehicle instrument displays, aircraft cockpits etc. When such displays are used in low light conditions, or when the observer is wearing image intensifying goggles to improve night vision, such high source brightness becomes a disadvantage. For this reason a number of methods of dimming LCD backlights have been developed.

One method of controlling the brightness of a glow discharge light source is to use a train of excitation pulses and to modify the duration of the pulses. This is known as pulse duration modulation, and the brightness of the light source can be reduced in proportion with the average power supplied to the lamp. There are, however, a number of drawbacks with such techniques. In U.S. Pat. No. 5,349,273 for example it is disclosed that only a 20:1 dimming range is possible because of significant illumination non-uniformity at low lamp currents, and because of a reduction in output voltage of the controller resulting in non-excitation of the discharge. Most commercially available fluorescent lamp dimmers have a dimming range of less than 150 to 1.

In U.S. Pat. No. 5,420,481 a supplementary set of electrodes are used to operate a glow discharge in a different manner in a low brightness regime. By switching from one set of electrodes to the other set it is possible to achieve a dimming range approaching 10,000:1 (or 80 dB) from 3000 cd $m^{-2}$ to 0.3 cd $m^{-2}$. However the maximum brightness of this lamp is not high enough for good contrast displays in bright sunlight, and the provision of extra electrodes and switching circuitry increases cost and decreases reliability and convenience of use. There can also be a discontinuous change in brightness when switching from one set of electrodes to the other set.

According to a first aspect of the invention there is provided a method of controlling the brightness of a discharge capable of operating in a first condition having a first brightness and in a further condition having a different brightness, the said conditions occurring in adjacent time periods, the method comprising a) supplying r.f. energy to the discharge as a train of pulses, and b) controlling the duration of the pulses, thereby controlling the ratio of the time spent by the discharge in the first condition to the time spent by the discharge in the further condition in any given time period, such that any change in the duty factor of the train of pulses is proportionally less than the resulting change in brightness of the discharge.

This method can provide brightness control which is continuously variable over a brightness range in excess of other known methods, the brightness range being surprisingly greater than the range of duty factor variation.

Preferably the method is such that in the first condition r.f. energy is mainly electric field coupled to the discharge and in the further condition r.f. energy is mainly magnetic field coupled to the discharge. The r.f. energy is advantageously mainly electric field coupled to the discharge at the start of a given pulse.

According to a second aspect of the invention, there is provided a method of controlling the brightness of a glow discharge capable of operating in a first condition having a first brightness and in a further condition having a different brightness, the said conditions occurring in adjacent time periods, the method comprising a) supplying r.f. energy to the discharge as a plurality of sets of pulses, each set having a different pulse duration, at least one set having a pulse duration sufficiently short that the discharge is in the said first condition for the whole duration of each pulse in the said at least one set, and at least are further set having a further pulse duration sufficiently long that the discharge passes into both conditions during each pulse in the said at least one further set, and b) controlling the repetition rate of the pulses comprising the at least one further set of pulses, thereby controlling the ratio of the time spent by the discharge in the first condition to the time spent by the discharge in the second condition in any given time period.

This method can provide a plurality of brightness levels which are less susceptible to temperature variations and other variables which are difficult to control.

According to a third aspect of the invention, there is provided a method of controlling the brightness of a glow discharge capable of operating in a first condition having a first brightness and in a further condition having a different brightness, the said conditions occurring in adjacent time periods, the method comprising a) supplying r.f. energy to the discharge as a plurality of sets of pulses, each set having a respective pulse duration, at least one set having a pulse duration sufficiently short that the discharge is in the said first condition for the whole duration of each pulse in the said at least one set, and b) controlling the duration of the pulses in each of the sets of pulses in synchrony with the other sets.

This method can also provide a plurality of brightness levels which are less susceptible to temperature variations and other variations which are difficult to control.

BRIEF DESCRIPTION OF THE DRAWINGS

Embodiments of the invention will now be described, by way of example only, with reference to the accompanying diagrammatic drawings in which:, FIGS. 1(*a–c*) shows trains of pulses according to the first aspect of the invention, FIGS. 2(*a–c*) shows the intensity of light emitted by the discharge during the pulses shown in FIG. 1.

DETAILED DESCRIPTION OF THE DRAWINGS

Flat inductively coupled discharge lamps have been developed as high performance backlights for liquid crystal devices. Such backlights have been described in detail in WO9507545 which is incorporated herein by reference. A lamp of the type described in WO9507545 is employed to generate the discharge in the following specific embodiments of a method of controlling the brightness of a discharge. The lamp comprises a sealed quartz envelope filled with a low pressure mixture of mercury and argon. One surface of the envelope carries a luminescent material such as a layer of a phosphor. The envelope is placed adjacent a spiral external driving electrode to which r.f. energy at 13.56 MHz is supplied in a train of pulses.

Figure 1A:
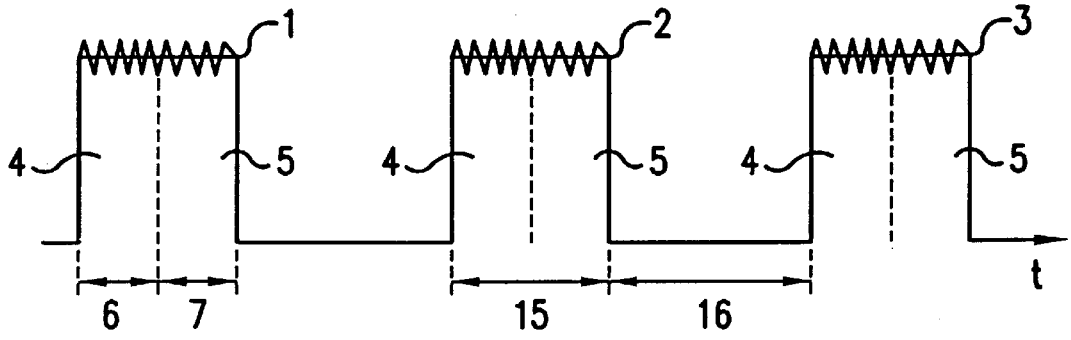
Figure 1B:
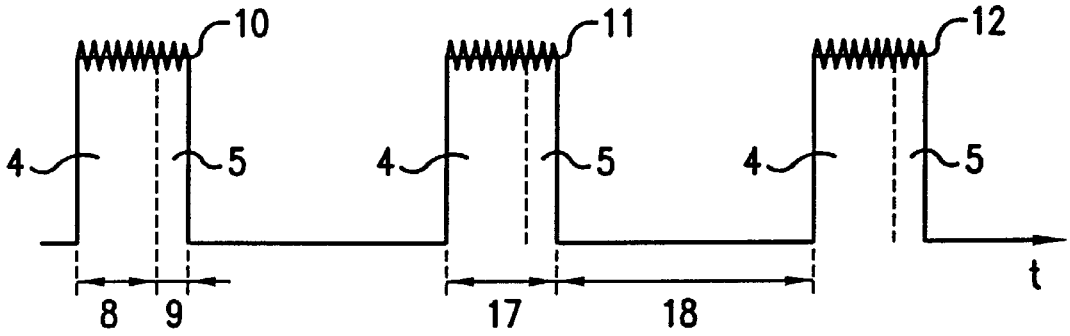
Figure 1C:
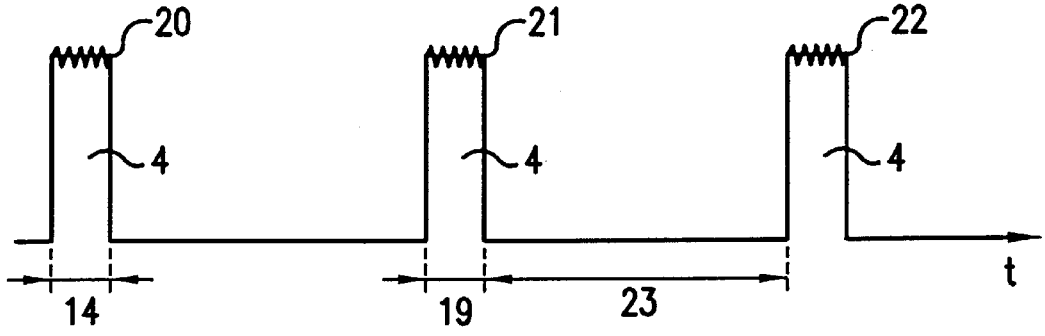

FIG. 1(*a*) shows schematically a first train of pulses according to a first aspect of the invention. FIG. 1(*b*) shows a second train of pulses according to a first aspect of the invention. The time period between pulses starting is constant in the two cases, but the duration of the pulses is different in the two cases, resulting in a different duty factor. FIG. 1(*c*) shows a third train of pulses having the same period but yet another duty factor. In each of these Figures the x axis corresponds to time. The y axis in each case is schematic in that it is equal to zero between pulses of r.f. energy and non-zero during each pulse of r.f. energy. The top of each pulse of r.f. energy is shown to be oscillating merely to help the reader recognize at which times the r.f. energy is applied. In the case of FIG. 1(*a*) the pulse duration is 4 ms and the time between pulses is 6 ms. The duty cycle is therefore 40% and the frequency of the pulses is 100 Hz. The luminance of a discharge lamp excited by 13.56 MHz r.f. power in this manner would typically be 4000 cd $m^{-2}$.

The inventors have observed that during each pulse the brightness of the discharge of a lamp of the kind described in WO9507545 is not constant. In particular there are two distinct conditions or regimes in which the lamp operates during each pulse. In the first condition (marked 4 in FIG. 1), which is generally the first condition when the pulse of r.f. energy is applied to the discharge, the brightness of the discharge is fairly low. This condition persists for a time 6 shown in FIG. 1*a*. The discharge then quickly flips into a second condition, labelled 5 in FIG. 1*a*, which lasts for a time 7 until the r.f. energy is no longer supplied to the discharge. The brightness of the discharge in this second condition is typically 30 to 100 times brighter than in the first condition. The intensity of light emitted by the discharge with time during the pulses shown in FIG. 1*a* is shown schematically in FIG. 2*a*. The same reference numerals are used to denote the same time periods and conditions in the two Figures.

It is believed that the two conditions having different brightness are due to the r.f. energy being coupled into the glow discharge via different mechanisms. At high peak r.f. powers, the energy is coupled into the glow discharge via the magnetic field generated by the external spiral electrode. This method of coupling is very efficient, but it takes a finite time for the glow discharge to be able to enter this condition.

For example, when starting a 40 watt magnetically coupled discharge this delay might be 1.5 milliseconds. In the time between the glow discharge 'striking' and the onset of the magnetic field coupled condition as described previously, energy is initially coupled into the glow discharge via the electric field generated between adjacent coils in the spiral electrode.

For sufficiently low r.f. powers, only electric field coupling is observed. However, for higher powers the electrically coupled initial discharge will flip into the more efficient magnetically coupled discharge after a short delay. This delay time depends upon a number of facts such as lamp temperature, electrode geometry, and input power. However for a given set of conditions the delay time is well defined. As a result, by choosing an appropriate modulation frequency (such as a few hundred Hertz) it is possible to controllably reduce the r.f. pulse duration (and hence duty factor) such that there is a smooth transition from electric field coupling followed by magnetic field coupling to electric field coupling alone.

The effect of reducing pulse duration is shown in FIGS. 1(*b*) and 1(*c*). In FIG. 1(*b*) the frequency has been kept constant at 100 Hz, but the pulse duration (17) has been reduced from 4 ms (in FIG. 1(*a*) to 3 ms, and the time between pulses (18) increased to 7 ms. As the width of the pulse decreases, so the proportion of time spent by the discharge running in the first condition (via electric field coupling) increases, thereby reducing the brightness of the lamp. Eventually, as the pulse duration is reduced, the pulse of r.f. energy is not long enough to enable the lamp to switch into the second condition. This state of affairs is shown in FIG. 1(*c*), where the pulse duration (19) has been reduced to less than 1.5 ms, and the time between pulses (23) increased to still give a pulse repetition rate of 100 Hz.

Figure 2A:
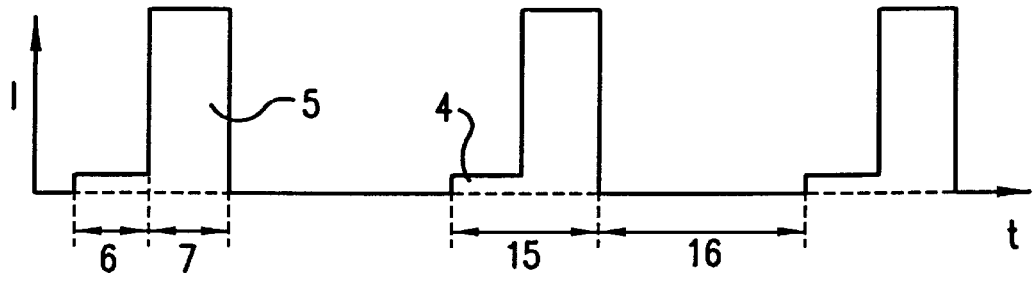
Figure 2B:
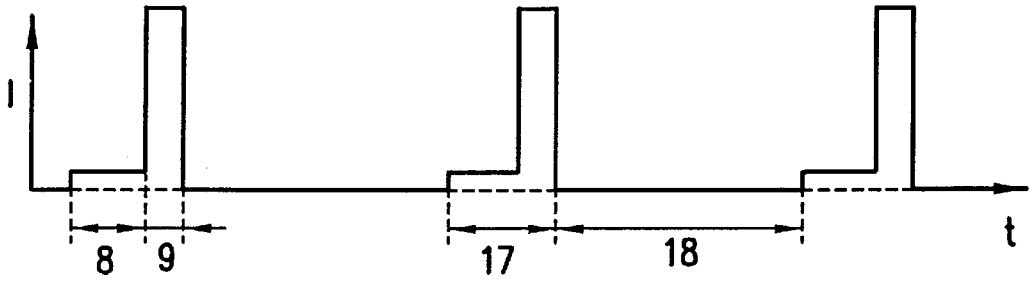
Figure 2C:
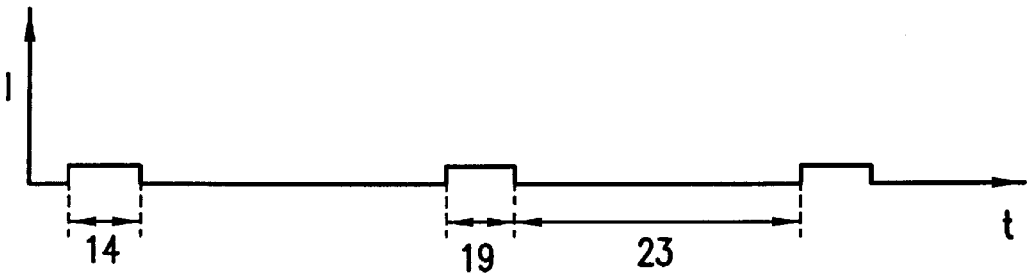

The intensity of light emitted by the lamp when being operated as in FIGS. 1(*b*) and (*c*) is shown schematically in FIGS. 2(*b*) and (*c*) respectively. Once again, the same reference numerals are used to denote the same features in each respective Figure. The average luminance or brightness of the discharge in FIGS. 2*a, b* and *c* is proportional to the area under the graph in each case.

It is apparent that the average luminance or brightness of the discharge decreases with decreasing pulse width, but it is also apparent that this decrease is proportionally much greater than the decrease in duty factor of the pulse train, due to the large difference in brightness or luminance of the first and second conditions of the discharge.

Figure 3:
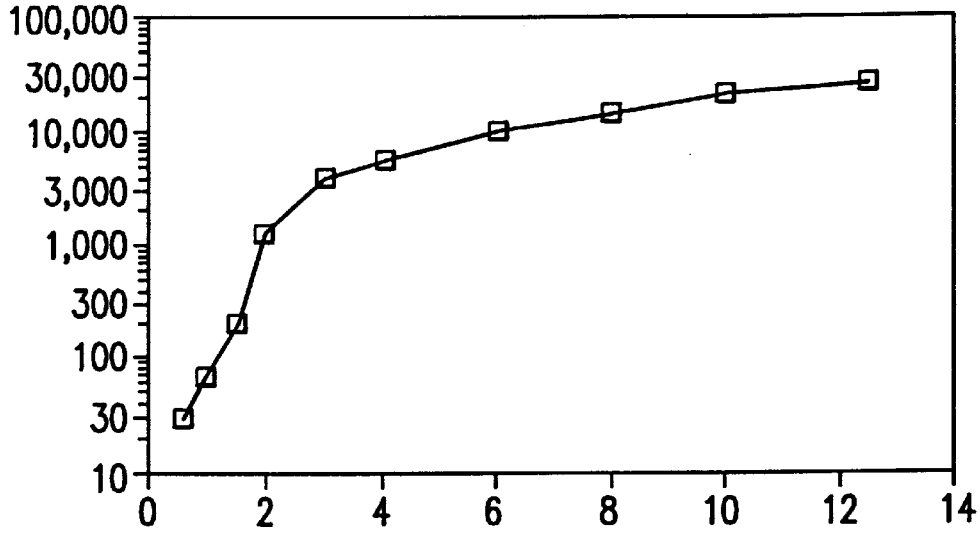
FIG. 3 shows the brightness of a discharge as a function of pulse duration at a pulse repetition rate of 100 Hz.
Figure 4:
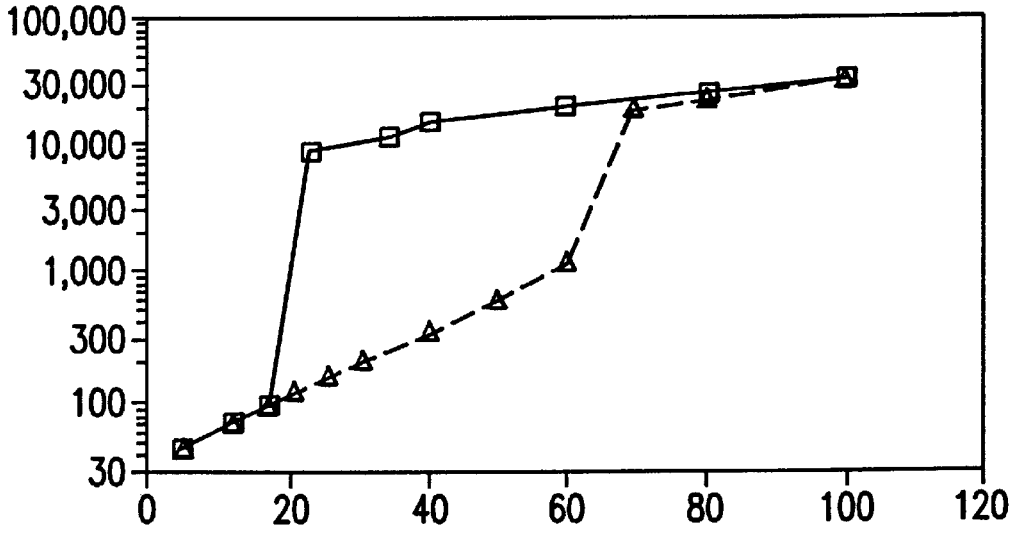
FIG. 4 shows the brightness of a discharge as a function of pulse duration at a pulse repetition rate of 10,000 Hz.

FIGS. 3 and 4 show how the luminance of a typical discharge according to the invention varies with duty factor. The y axes in the figures corresponds to the luminance expressed in cd $m^{-2}$, whilst the x axes denote pulse duration. FIG. 4 shows how the discharge behaves at a pulse repetition rate of 10 kHz, whilst FIG. 3 shows the behaviour at 100 Hz. The x axes are linear whilst the y axes are logarithmic.

In FIG. 4, the data points marked with a triangle were measured when increasing pulse duration, whilst the data points marked with a square were measured when decreasing the pulse duration. The fact that the two sets of data points do not lie on the same curve is an indication that at high repetition rates (and correspondingly short pulse durations) hysteresis becomes important.

This is most likely due to the possibility of bypassing the first (electric field coupling) condition if the time since the discharge was last in the second (magnetic field coupling) condition is less than a characteristic relaxation time of the glow discharge. If the time between the end of a magnetic field coupled r.f. energy pulse and the start of a subsequent pulse is sufficiently short that populations of electrons ions and radicals in the lamp have not had time to relax back to the values present during electric field coupling or before any excitation began, then the subsequent pulse may go straight into the second (magnetic field coupling) condition without passing through the first condition. From the experimental results shown in FIG. 4 this can be calculated to be approximately 80 $\mu$s for the particular lamp and input power shown in FIG. 4.

In FIG. 3 the data points were taken at a repetition rate of 100 Hz, so that the length of time between pulses was always greater than 100 $\mu$s so that such hysteresis is not observed.

It will be observed from FIG. 4 that there will be a significant step in brightness between the regime in which electric field coupling is the only coupling mechanism and the regime in which magnetic field coupling is present. Such a "brightness gap" is undesirable for applications such as backlighting of displays. The "brightness gap" is less pronounced in the case of FIG. 4 when the pulse repetition rate is lower. The reasons for this are not well understood. One effect which can be used to overcome this gap in brightness is to change the r.f. power being delivered in each pulse. It is observed that the time duration of the first (electric field coupling) condition depends upon the power being supplied to the discharge. If the power is high, the time before the discharge switches into its second condition is short. If the power is reduced, the time before the discharge switches into its second condition is greater. There is a critical power level below which the second condition is never achieved. By combining variation of the duty cycle with variation in the r.f. power supplied during each pulse it is possible to mitigate the disadvantage of a brightness gap.

Figure 5:
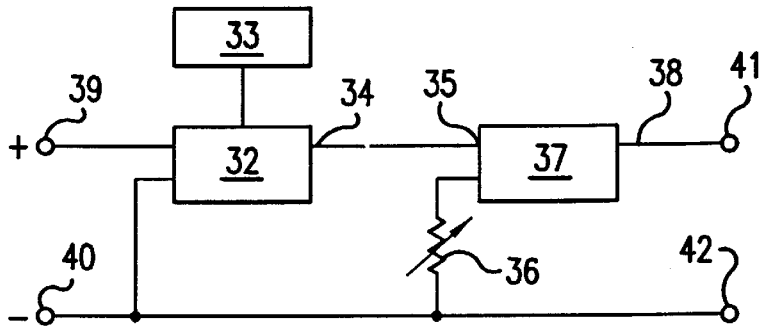
FIG. 5 shows a block diagram of the pulse controller used to give the results of FIG. 3 and FIG. 4.

A block diagram of the system which controls the pulse duration is shown in FIG. 5. A 14 volt d.c. power supply is provided at input terminals 39 and 40. This powers an NE566 Function Generator integrated circuit (32). This circuit provides a triangular output waveform at output 34. The repetition rate of this waveform is regulated by an RC network (33) which is provided on a neighbouring part of a common PCB. In normal use the frequency is not adjusted. The triangular output waveform is supplied as one input (35) to an LM 311 comparator integrated circuit (37). The other input to the comparator is provided by a d.c. level set by an adjustable potentiometer (36). The d.c. level acts to trigger the comparator twice per cycle as the triangular waveform passes through a predetermined level whilst increasing and again whilst decreasing. Thus the output of the comparator (38) will be in the shape of a square wave, with the duration of each pulse determined by the d.c. level set by the potentiometer. Changing the d.c. level by adjusting the potentiometer will alter the square wave pulse duration at output terminals 41 and 42 without altering the repetition rate of the pulses.

The second aspect of the invention provides a method of controlling the brightness of a glow discharge which mitigates the disadvantage of the "brightness gap" as described above.

Figure 6A:
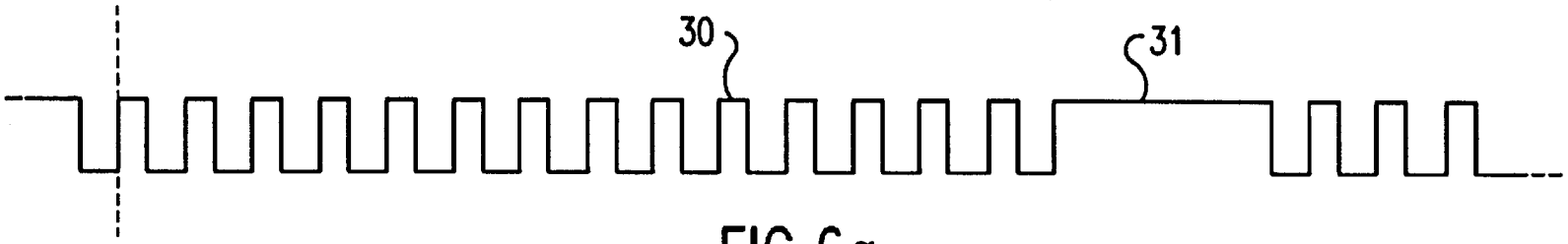
FIGS. 6(*a–c*) shows trains of pulses according to a second aspect of the invention.
Figure 6B:
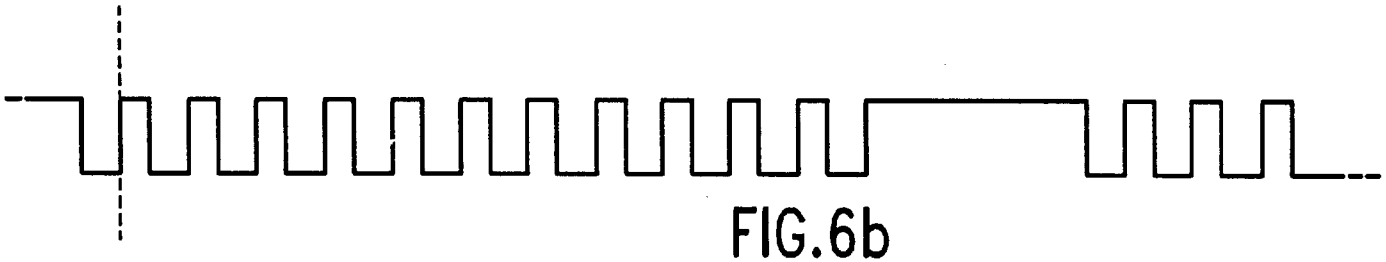
Figure 6C:
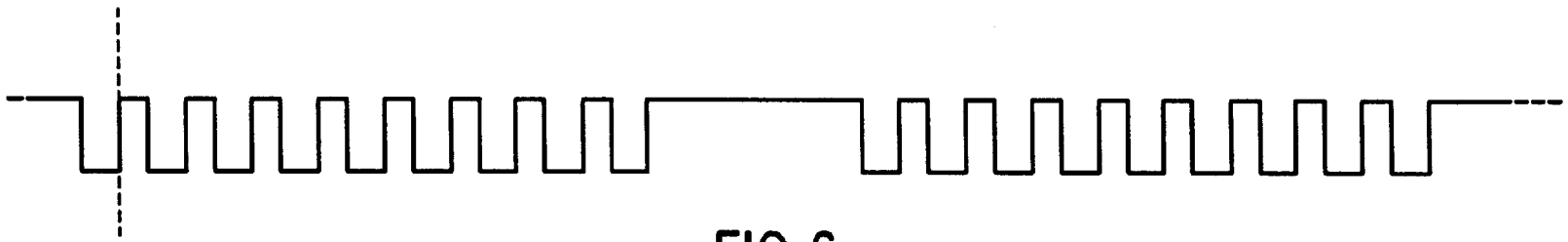

FIGS. 6(*a*), (*b*) and (*c*) illustrate three different pulse trains according to this second aspect of the invention. In this figure, as in FIG. 1, the x axes corresponds to time and the y axes correspond to the presence or absence of r.f. energy. In each case the pulse train comprises a plurality of sets of pulses (in the present example two sets), the sets of pulses having different repetition rates and having different pulse durations. The duration of the first set of pulses (30) is arranged to be such that the glow discharge will always be in the first condition. That is, it will be mainly electric field coupled for the whole duration of each pulse in the set. In the present case each pulse in the first set has a duration of 0.2 ms and a gap of 0.3 ms. In FIG. 6(*a*) every 15th pulse in the pulse train is arranged to have a duration of 1.6 ms, forming a further set (31) of pulses having a lower repetition rate and a different duration. The period of the longer pulses will be (0.5 ms×14+1.6 ms) or 8.6 ms, yielding a repetition rate of just over 116 Hz. In FIG. 6(*b*) every 12th pulse in the pulse train is arranged to have a duration of 1.6 ms. The period of the set of longer pulses in this case will be (0.5 ms×11+1.6 ms) or 7.1 ms. In FIG. 6(*c*) every 9th pulse in the pulse train has a duration of 1.6 ms, giving a period of (0.5 ms×8+1.6 ms) or 5.6 ms.

In this way, the repetition rate of the further set of pulses (i.e. longer pulses in the present example) is increased, whilst the repetition rate of the set of shorter pulses remains the same. When the average brightness of the glow discharge produced in each case is compared, it is found that a 'grey scale' of different average brightness levels has been produced. The 'brightness gap' between each grey level is not as large as that produced by the pulse trains in FIG. 1 because all the pulses in the train do not have their durations increased at the same time.

To compare the brightness levels of the examples shown in FIG. 6 we must calculate the average brightness in each case. For example, if we assume that the luminance in the first condition is equal to 1, and that in the second condition is equal to 50 (in arbitrary units), and that the switch from one condition to the other occurs after 1.5 ms pulse duration, then the average brightness in the example of FIG. 6(*a*) will be (1×0.2 ms×14+50(1.6−1.5))×116 Hz or 905 arbitrary units. FIG. 6(*b*) will be (1×0.2 ms×11+50(1.6−1.5))×141 Hz or 1014 arbitrary units, and FIG. 6(*c*) will be (1×0.2 ms×8+50(1.6−1.5 ms))×179 Hz or 1179 arbitrary units. If only short pulses were used the average brightness would be 1×0.2×2 kHz=400 arbitrary units. Brightness below 905 arbitrary units may be produced by increases the number of short pulses between long pulses above the fifteen shown in FIG. 6(*a*).

However, because it is undesirable to have the light appear to flicker it is important to keep the repetition rate above the critical fusion frequency for an observer (which may typically be 70–90 Hz. If brightnesses below 400 arbitrary units were required, conventional pulse time modulation techniques may be used on the shorter pulses alone.

In the example of FIG. 6, the brightest possible condition is where a long pulse occurs each time, with in this example a 0.3 ms gap between pulses.

It is important to keep the gap between successive pulses sufficiently long so that the next pulse does not start to glow in the further (magnetic field coupled) condition, thereby bypassing the first condition completely.

The trains of pulses shown in FIG. 6(*a*) may be generated by a pulse generator triggered under computer control according to the following algorithm:

1. Reset pulse counting shift register to read zero.
2. Generate a pulse of duration 0.2 ms.
3. Add 1 to number in pulse counting shift register.
4. Wait for 0.3 ms.
5. If pulse counting shift register does not read "14", go to 2.
6. If pulse counting shift register reads 14, continue.
7. Generate a pulse of duration 1.6 ms.
8. Wait for 0.3 ms.
9. Go to 1.

To control discharge brightness, the integer '14' in steps 5 and 6 would be altered. For example, it may be altered to "11" to give the pulse train of FIG. 6(*b*), or "8" to give the pulse train of FIG. 6(*c*). The generation of the pulses in steps 2 and 7 may be performed by different pulse generators. The pulse time control means employed can take many forms whilst remaining with the scope of the present invention. Persons skilled in the pulse control art will be able to design many circuits which would be able to produce the pulse trains of FIG. 6.

The third aspect of the invention provides a further method of controlling or regulating the brightness of a glow discharge which also mitigates the disadvantage of the brightness gap and temperature variation effects as described above.

Figure 7:
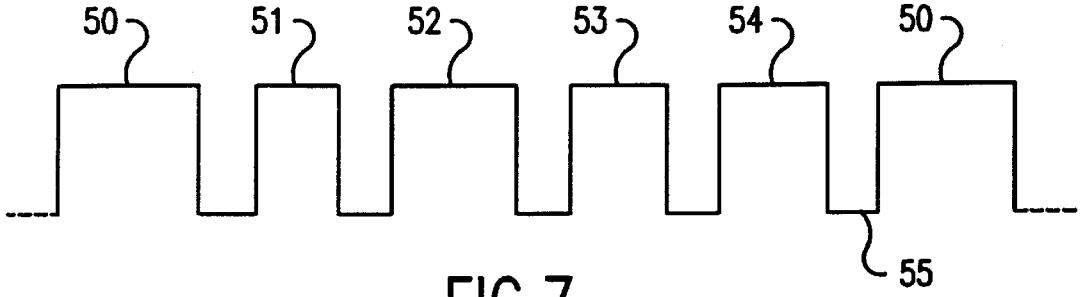
FIG. 7. shows a pulse train according to a third aspect of the invention.

FIG. 7 illustrates a pulse train according to this third aspect of the invention. The pulse train comprises a sequence of 6 pulses, each pulse having a different duration. The train of 6 pulses is repeated to form a continuous pulse train. The train of pulses therefore comprises, in effect, 6 sets of pulses each set having the same repetition rate but a different duration. In the example shown in FIG. 7, the pulse durations are as follows: 2 ms (50), 1.2 ms (51), 1.8 ms (52), 1.4 ms (53) and 1.6 ms (54).

There is a gap of 0.5 ms (55) between each pulse. The brightness control according to this aspect of the invention is achieved by changing the duration of all the pulses, but keeping the ratio of the pulse durations from set to set constant.

The duration of the pulses therefore becomes 2×d, 1.2×d, 1.8×d, 1.4×d and 1.6×d, with d being varied to adjust glow discharge brightness.

As d is varied, a different number of the pulses in a given time period will have a duration long enough to excite the glow discharge into the second (magnetic field coupled) condition having a higher brightness. Thus there are, in effect, a plurality of 'grey-levels' depending on how many of the sets of pulses have a duration greater than some critical duration (in the present example 1.5 ms). The embodiment as described would yield 6 grey levels, but greater or few levels would be provided by having a different number of sets of pulses.

Figure 8A:
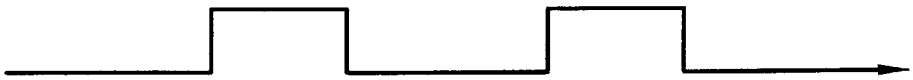
FIGS. 8(*a–b*) shows a pulse train according to a fourth aspect of the invention.
Figure 8B:
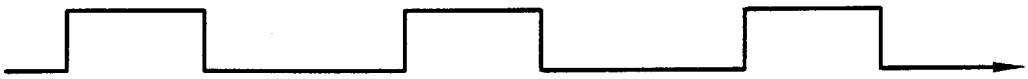

FIGS. 8(*a*) and 8(*b*) each show a pulse train according to an advantageous embodiment of the invention. The method is employed to control a two dimensional array consisting of two discharges as previously described. The discharges are spatially adjacent one another. One is supplied with the train of pulses as shown in FIG. 8(*a*), and the other with the train of pulses as shown in 8(*b*). Thus, adjacent discharges are supplied with r.f. power in different time intervals. As a result, there is a reduced interference caused by a plurality electromagnetic fields being coupled to a given discharge simultaneously. For two nearest neighbour discharges this is possible if the duty factor of each pulse train is less than 50%. For a square array having 4 nearest neighbours, a duty factor of less than 25% for each of the plurality of pulse trains would enable all spatially adjacent discharges to be excited during different time periods. In general, a duty factor of less than 100/u % is required for an array having u nearest neighbours.

Finally, the contents of the accompanying abstract is incorporated herein by reference.

What is claimed is:

1. A method of controlling the brightness of a glow discharge capable of operating in a first condition (4) having a first brightness and in a further condition (5) having a different brightness, said conditions occurring in adjacent time periods, the method comprising the steps of:

a) supplying r.f. energy to the discharge as a train of pulses (1, 2, 3), and b) controlling the duration of the pulses, thereby controlling the ratio of the time spent by the discharge in the first condition to the time spent by the discharge in the further condition in any given time period, such that any change in the duty factor of the train of pulses is proportionally less than a resulting change in brightness of the discharge.

2. A method as claimed in claim 1 in which in the first condition r.f. energy is mainly electric field coupled to the discharge at the start of a given pulse.

3. A method as claimed in claim 1 in which in the further condition r.f. energy is mainly magnetic field coupled to the discharge.

4. A method as claimed in claim 1 in which the duty factor of the train of pulses is less than 50%.

5. A method as claimed in claim 1 in which a pulse repetition rate is greater than a critical fusion frequency for an observer.

6. A method as claimed in claim 1 in which a pulse repetition rate is less than the frequency of the r.f. energy being supplied.

7. A method as claimed in claim 1 in which r.f. energy is supplied to an array of glow discharges in a train of pulses, such that spatially adjacent glow discharges are supplied with a pulse in a different time period.

8. A method of controlling the brightness of a glow discharge capable of operating in a first condition (4) having a first brightness and in a further condition (5) having a different brightness, said conditions occurring in adjacent time periods, the method comprising the steps of:

a) supplying r.f. energy to the discharge as a plurality of sets of pulses (30, 31), each set having a different pulse duration, at least one set (30) having a pulse duration sufficiently short that the discharge is in said first condition for the whole duration of each pulse in said at least one set, and at least one further set (31) having a further pulse duration sufficiently long that the discharge passes into both conditions during each pulse in said at least one further set, and b) controlling the repetition rate of the pulses comprising the at least one further set of pulses, thereby controlling the ratio of the time spent by the discharge in the first condition to the time spent by the discharge in the second condition in any given time period.

9. A method as claimed in claim 8 in which in the first condition r.f. energy is mainly electric field coupled to the discharge at the start of a given pulse.

10. A method as claimed in claim 8 in which in the further condition r.f. energy is mainly magnetic field coupled to the discharge.

11. A method as claimed in claim 8 in which the duty factor of the train of pulses is less than 50%.

12. A method as claimed in claim 8 in which the pulse repetition rate is greater than a critical fusion frequency for an observer.

13. A method as claimed in claim 8 in which the pulse repetition rate is less than the frequency of the r.f. energy being supplied.

14. A method as claimed in claim 8 in which r.f. energy is supplied to an array of glow discharges in a train of pulses, such that spatially adjacent glow discharges are supplied with a pulse in a different time period.

15. A method of controlling the brightness of a glow discharge capable of operating in a first condition (4) having a first brightness and in a further condition (5) having a different brightness, said conditions occurring in adjacent time periods, the method comprising the steps of:

a) supplying r.f. energy to the discharge as a plurality of sets of pulses (50, 51, 52, 53, 54), each set having a respective pulse duration, at least one set (51) having a pulse duration sufficiently short that the discharge is in said first condition for the whole duration of each pulse in said at least one set, and b) controlling the duration of the pulses in each of the sets of pulses in synchrony with the other sets.

16. A method as claimed in claim 15 in which successive pulses have different durations.

17. A method as claimed in claim 15 in which in the first condition r.f. energy is mainly electric field coupled to the discharge at the start of a given pulse.

18. A method as claimed in claim 15 in which in the further condition r.f. energy is mainly magnetic field coupled to the discharge.

19. A method as claimed in claim 15 in which the duty factor of the train of pulses is less than 50%.

20. A method as claimed in claim 15 in which a pulse repetition rate is greater than a critical fusion frequency for an observer.

21. A method as claimed in claim 15 in which a pulse repetition rate is less than the frequency of the r.f. energy being supplied.

22. A method as claimed in claim 15 in which r.f. energy is supplied to an array of glow discharges in a train of pulses, such that spatially adjacent glow discharges are supplied with a pulse in a different time period.

* * * * *